United States Patent [19]

Oberdorf

[11] Patent Number: 5,038,546

[45] Date of Patent: Aug. 13, 1991

[54] METHOD AND APPARATUS FOR PACKAGING CIGARETTES OR THE LIKE

[75] Inventor: Manfred Oberdorf, Gevelsberg, Fed. Rep. of Germany

[73] Assignee: Maschinenfabrik Alfred Schmermund GmbH & Co., Gevelsberg, Fed. Rep. of Germany

[21] Appl. No.: 584,767

[22] Filed: Sep. 19, 1990

[30] Foreign Application Priority Data

Sep. 20, 1989 [DE] Fed. Rep. of Germany ..... 3931309

[51] Int. Cl.[5] ..... B65B 51/10

[52] U.S. Cl. ..... 53/202; 53/387.4

[58] Field of Search ..... 53/202, 170, 176, 234, 53/388

[56] References Cited

U.S. PATENT DOCUMENTS

| | | | |
|---|---|---|---|
| 3,538,678 | 11/1970 | Lefort | 53/202 X |
| 4,467,847 | 8/1984 | Zodrow | 53/202 X |
| 4,476,665 | 10/1984 | Oberdorf | 53/234 X |
| 4,484,432 | 11/1984 | Oberdorf | 53/388 X |
| 4,819,407 | 4/1989 | Focke | 53/234 X |

*Primary Examiner*—John Sipos

*Attorney, Agent, or Firm*—Chilton, Alix & Van Kirk

[57] ABSTRACT

The packaging of cigarettes, particularly in a bottom-folding packer, is expedited by utilizing two separate packaging lines to feed a common drying turret. The drying turret has a pair of cell supporting rotors with the first of these rotors receiving, at a pair of diametrically opposed locations, formed packages from the two lines. The packages, in the course of drying, are transferred in pairs between the first and second rotors of the drying turret and, during such transfer, sealing stamps are affixed thereto.

14 Claims, 1 Drawing Sheet

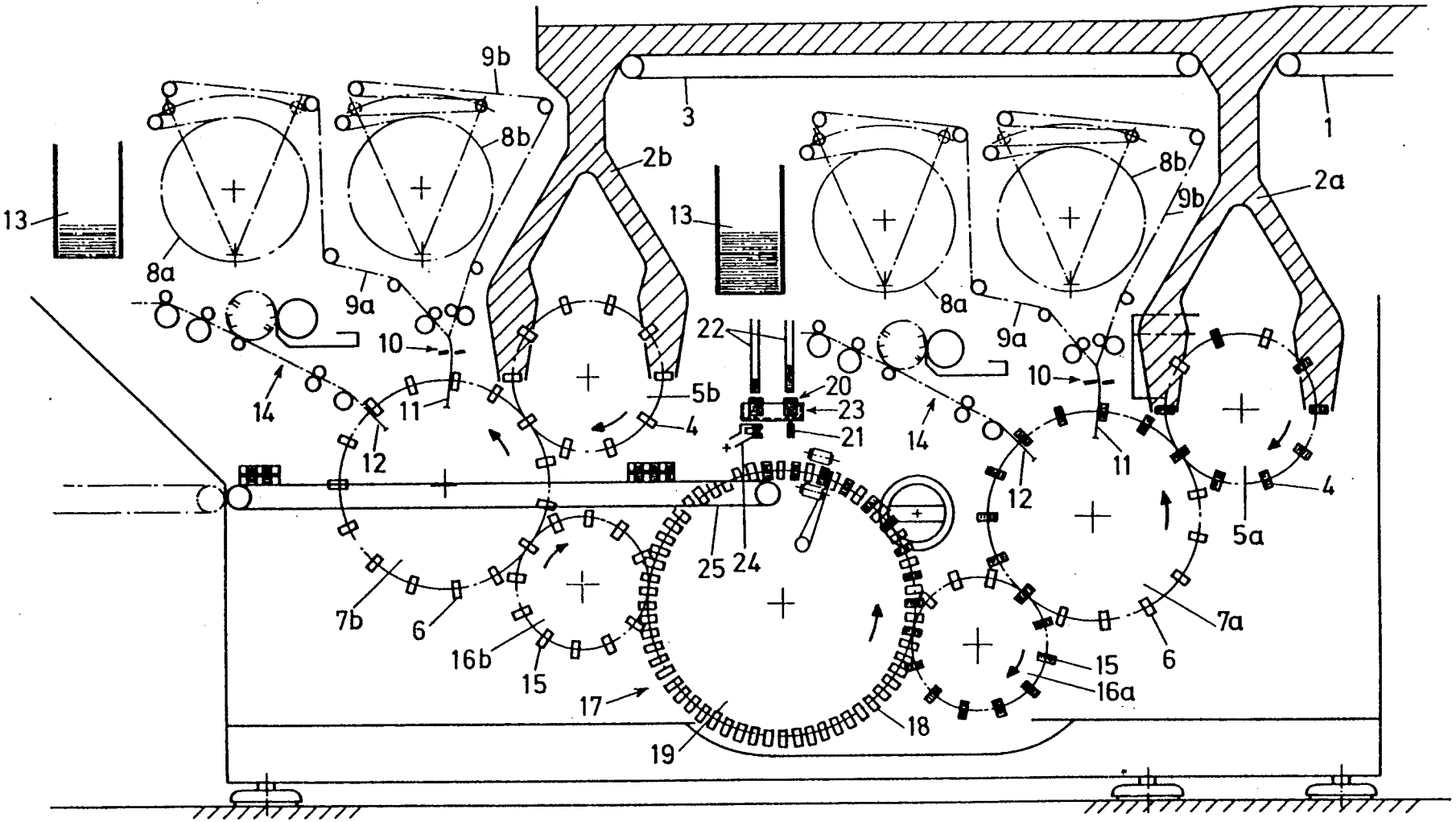
1
2a
2b
3
4
5a
5b
6
7a
7b
8a
8b
9a
9b
10
11
12
13
14
15
16a
16b
17
18
19
20
21
22
23
24
25

METHOD AND APPARATUS FOR PACKAGING CIGARETTES OR THE LIKE

BACKGROUND OF THE INVENTION

1. Field of the Invention.

The present invention relates to the packaging of groups of articles and particularly to enhancing the speed of formation of cigarette packages by folding wrappers about blocks of cigarettes and sealing such folded wrappers. More specifically, this invention is directed to improved packaging apparatus wherein groups of cigarettes, combined to form cigarette blocks, are wrapped in inner paper and then enveloped in an appropriately adhesively coated outer-paper blank, the apparatus including means for folding the top and bottom ends of the wrappers and affixing a sealing stamp over the last closed end of the package. Accordingly, the general objects of the present invention are to provide novel and improved methods and apparatus of such character.

2. Description of the Prior Art.

Methods of and apparatus for the formation of packages about blocks of cigarettes are well-known in the art. A commonly employed cigarette package forming apparatus is known in the art as a "bottom-folding packer". An example of such a "bottom-folding packer" may be seen from German Patent No. 3,046,063 (see U.S. Pat. No. 4,476,665). In the operation of the apparatus of German Patent 3,046,063, two diametrically opposed cells supported on a block-forming turret are simultaneously filled with cigarettes from a double hopper and the cigarette blocks thus formed are subsequently transferred in pair, to a press turret which is equipped with specially oriented cells. The cigarette blocks are pushed, in pairs, from the cells of the press turret into cells of a wrapping turret. At the wrapping turret, the cigarette blocks are wrapped with inner and outer paper wrappers to form open-topped packs. The next step in the package forming operation comprises the transfer of the wrapped cigarette blocks to a top-closing turret wherein the partially completed packages are closed at the top end by folding. The partially formed packages are then transferred to cells of a drying turret which consists of two cellular wheels arranged in succession, the packages being moved from one wheel of the drying turret to the other by means of double slides. Sealing stamps are affixed to the folded package tops at the time the packages are transferred from the first cellular wheel of the drying turret to the other drying turret wheel. After a relatively long rotation, required for the adhesive to set, the finished packages are pushed out of the second wheel of the drying turret. The use of specially designed press and top-closing turrets enables apparatus such as depicted in German Patent 3,046,063, to operate at a higher packaging speed than has characterized previous apparatus of such character. It is, however, desired to further increase packaging speed.

Published European Patent Application 268,917 also depicts a cigarette packaging machine. The apparatus of European Application 268,917 employs a common drive for the folding units and conveyors of a pair of packaging lines. However, the speed of operation of this apparatus is limited by the fact that each packaging line is provided with its own drying turret.

SUMMARY OF THE INVENTION

The present invention overcomes the above-briefly-discussed and other deficiencies of the prior art by providing a novel bottom-folding packer characterized by significantly increased production capability, when compared to the prior art, without increasing the speed of the individual wrapper folding operations. Apparatus in accordance with the invention also has the characteristic and advantage that it can be fabricated at modest cost. The present invention also encompasses a cigarette packaging technique wherein the folding operations employed in package formation take place essentially in a single plane and in an uncomplicated and easily controllable manner.

In accordance with the present invention, a pair of packaging lines terminate on opposite sides of a common drying turret. Cigarette packages formed upstream of the drying turret on the two lines are moved into respective cells of a first cellular wheel of the drying turret in simultaneous fashion at a pair of transfer stations. An even number of cells is provided on the first cellular wheel of the drying turret in the space between the transfer stations. The cigarette packages are transferred in pairs from adjacent cells of the first cellular wheel of the drying turret into cells on the second wheel of the drying turret by means of a double slide mechanism and, during such transfer, sealing stamps are applied over the package tops.

An apparatus in accordance with the present invention has the capability of doubling package speed in comparison to that obtainable from a conventional prior art packer which comprises a single packaging line. The two packaging lines of the present invention, as noted, terminate in a common drying turret which includes a device for affixing the sealing stamps to the packages.

BRIEF DESCRIPTION OF THE DRAWING

The present invention may be better understood, and its numerous objects and advantages will become apparent to those skilled in the art, by reference to the accompanying drawing which is a schematic illustration of apparatus in accordance with the invention.

DESCRIPTION OF THE DISCLOSED EMBODIMENT

Referring now to the drawing, individual cigarettes (not shown) are delivered to the packer via a feed belt 1, the axes of the incoming cigarettes being oriented generally transversely with respect their direction of motion. The arriving cigarettes are allocated to two packaging lines. Thus, some of the supplied cigarettes are delivered directly into a double hopper, indicated at *2a*, of the first packaging line while the remainder of the cigarettes are delivered, via an auxiliary feed belt 3, to a double hopper *2b* of the second packing line. The hoppers *2a*, *2b* each define a pair of shafts. A series of cigarettes, arranged one above another, will be established in each of the shafts. These cigarettes are pushed from the stacks thus formed into cells 4 provided on block-forming turrets *5a*, *5b* by means of rams or the like, not shown. The loading of the cells 4 of the block-forming turrets is accomplished in such a manner that a pair of diametrically opposed cells on each turret are simultaneously filled. The filing of the cells, i.e., the formation of the cigarette blocks, may be accomplished in such a manner that every second cell 4 is filled from one shaft while the intermediate cells are filled from the other shaft, the turrets 5*a*, 5*b* being moved in stepwise fashion.

The cigarette blocks from the cells 4 of the block-forming turrets are individually transferred, in succession, to cells 6 of associated wrapping turrets 7*a*, 7*b*. The wrapping turrets rotate in the opposite direction from their associated block-forming turrets as indicated. An inner wrapper paper in the form of a web is provided for each packaging line by being withdrawn from pairs of supply reels 8*a*, 8*b*. The web, either 9*a* or 9*b* depending on which of the supply reels is functioning as the wrapper source, is fed through a severing device 10 via appropriate rollers and pendulums, the pendulums keeping the web taut. The package inner wrapper 11, after being severed from the web by the severing device 10, is guided in front of a filled advancing cell 6 of a wrapping turret and is folded by means of appropriate folding members, not shown, around the cell and the cigarette block located therein. Next, in the direction of rotation of each wrapping turret, an outer paper blank, for example a cardboard blank 12, is extracted from a magazine 13, coated in the appropriate areas with an adhesive by an adhesive-coating device 14, and fed into registration with the cell with applied inner wrapper. The outer paper blank 12 is then at least partly wrapped around the cell and inner paper by means of further folding members, not shown. At this stage, the packages being formed remain open at the top.

The open-topped cigarette packages are next pushed, by means of slide mechanisms, out of the cells 6 of the wrapping turrets into cells 15 of top-closing turrets 16*a*, 16*b*. As the top-closing turrets rotate, folding members, not shown, fold the inner and outer wrappers to close the tops of the packages.

The top-closing turrets 16*a* and 16*b* are located on opposite sides of a common drying turret 17. Packages are simultaneously transferred, into diametrically opposed cells 18 of a first wheel or rotor 19 of the drying turret 17, from the top-closing turrets by means of slide mechanisms. The drying turret 17 has a pair of the cellular wheels 19 which are both coaxial and axially separated. The two cellular wheels 19 of the drying turret have the same number of package receiving cells and the cells on the two wheels are aligned with one another. An even number of cells 18 are provided on the first wheel 19 between a pair of cells which are positioned at the opposed transfer stations to simultaneously receive packages from the top-closing turrets 16*a* and 16*b*. The drying turret 17 is controlled so that the cellular wheels 19 move, in stepwise fashion, by two cell divisions at time. Accordingly, with each step, a pair of filled cells 18 will be presented to a device, indicated generally at 20, which affixes sealing stamps to the packages.

The sealing stamp affixing device 20 comprises a pair of magazines 22 which simultaneously supply stamps 21, via a glue-coating device indicated generally at 23, to lever-type applicators 24. The applicators 24 employ a vacuum to hold the stamps and have fork-shaped ends with tines which are sized and spaced so that the packages in the cells 18 may pass therebetween. The applicators 24 are extendable into the spacing between the cellular wheels 19 of the drying turret 17 such that, as the packages are pushed from cells on the first wheel 19 into cells on the second wheel 19, by means of a double slide, a sealing stamp 21 will be applied to the package with the projecting ends of the stamp being wrapped around the end of the package. The pair of packages with freshly applied sealing stamps being pushed into cells on the second wheel will push a pair of dried packages from the second of wheels 19 onto a discharge conveyor 25.

It is to be noted that, rather than employing top-closing turrets 16*a*, 16*b*, some other type of device for closing the tops of the packages can be utilized. An alternative top-closing device may, for example, comprise a conveyor chain which is equipped with cells, the cells cooperating with folding members of appropriate design.

As will be obvious to those skilled in the art from the above description, the various turrets of apparatus in accordance with the present invention are provided with radially aligned cells and are offset relative to one another in the axial direction so as to permit the transfer of partially formed packages between the cells of adjacent turrets. The stepped rotation of all of the turrets is accomplished by individual drives which are coupled to a common central drive.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In apparatus for the packaging of cigarettes, the apparatus including a first package forming line in which individual cigarettes are combined to form cigarette blocks which are wrapped in an inner wrapper and subsequently enveloped in an appropriately adhesive-coated outer wrapper, the wrappers being folded over the opposite ends of the blocks to completely close the packages, the closed packages being transferred to a drying turret, the drying turret consisting of two axially spaced rotors arranged coaxially, each rotor of the drying turret having a plurality of package receiving cells with the cells on the two rotors being in alignment, the drying turret being rotated in step-wise fashion two cell divisions at a time, the apparatus further having means for simultaneously transferring two packages from adjacent cells of the first rotor of the drying turret to aligned cells of the second rotor, the apparatus also having means for affixing sealing stamps to the two packages during the transfer between the rotors of the drying turret, the improvement comprising a second package forming line which terminates at the drying turret at a position which is diametrically opposed to the point of termination of the first package forming line whereby packages may be transferred into a pair of diametrically opposed cells of the first rotor of the drying turret, the rotors of the drying turret being provided with an even number of package receiving cells disposed between each pair of cells which are in alignment with the termination of the package forming lines.

2. The apparatus of claim 1 wherein the two package forming lines terminate in multi-celled top-closing turrets, the wrappers being folded to close the top of the packages while the packages are disposed in the top-closing turrets, package receiving cells of the top-closing turrets being axially alignable with the said diametrically opposed cells of the rotors of the said drying turret.

3. The apparatus of claim 1 wherein each packaging line includes a multi-celled block-forming turret into which individual cigarettes are delivered to form cigarette blocks to be packaged, and each packaging line further includes a double hopper for the delivery of cigarettes to a pair of displaced cells of each block forming turret.

4. The apparatus of claim 2 wherein each packaging line includes a multi-celled block-forming turret into which individual cigarettes are delivered to form cigarette blocks to be packaged, and each packaging line further includes a double hopper for the delivery of cigarettes to a pair of displaced cells of each block forming turret.

5. The apparatus of claim 1 wherein each of said packaging lines comprises a multi-celled block-forming turret, individual cigarettes being grouped into blocks of cigarettes in the cells of the block forming turret, a hopper for supplying cigarettes to the block-forming turret, a multi-celled wrapping turret wherein inner and outer wrappers are formed about blocks of cigarettes transferred to the wrapping turret from the block-forming turret, and a multi-celled top-closing turret wherein the tops of cigarette packages partially formed on the wrapping turret are closed.

6. The apparatus of claim 5 wherein said top-closing turrets are positioned adjacent to said drying turret whereby cells of the top-closing turrets will be axially alignable with cells of the drying turret.

7. The apparatus of claim 6 wherein each of said hoppers is a double hopper.

8. The apparatus of claim 1 wherein cigarettes are delivered to said packaging lines from a common source.

9. The apparatus of claim 2 wherein cigarettes are delivered to said packaging lines from a common source.

10. The apparatus of claim 3 wherein cigarettes are delivered to said packaging lines from a common source.

11. The apparatus of claim 4 wherein cigarettes are delivered to said packaging lines from a common source.

12. The apparatus of claim 5 wherein cigarettes are delivered to said packaging lines from a common source.

13. The apparatus of claim 6 wherein cigarettes are delivered to said packaging lines from a common source.

14. The apparatus of claim 7 wherein cigarettes are delivered to said packaging lines from a common source.

* * * * *